US006513480B1

(12) United States Patent
Albertson et al.

(10) Patent No.: US 6,513,480 B1
(45) Date of Patent: Feb. 4, 2003

(54) PICK-UP TUBE FOR HYDRAULICALLY-ACTUATED VALVE DEACTIVATION

(75) Inventors: William Conrad Albertson, Clinton Township, MI (US); Rodney E. Baker, Burton, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/956,358

(22) Filed: Sep. 20, 2001

(51) Int. Cl.[7] ..... F02B 77/00; F01L 9/02

(52) U.S. Cl. ..... 123/198 F; 123/196 R; 123/90.12

(58) Field of Search ..... 123/198 F, 90.12, 123/90.13, 90.33, 196 R

(56) References Cited

U.S. PATENT DOCUMENTS 2,123,681 A * 7/1938 Willgoos 6,196,175 B1 3/2001 Church ..... 123/90.16

* cited by examiner

*Primary Examiner*—Bibhu Mohanty
(74) *Attorney, Agent, or Firm*—Leslie C. Hodges

(57) ABSTRACT

An engine assembly includes an engine block with a laterally extending oil supply gallery formed therethrough. The engine block includes an aperture formed in fluid communication with the oil supply gallery. The hydraulically-actuated valve deactivation system is positioned in fluid communication with the aperture for receiving pressurized oil from the oil supply gallery. A pick-up tube is positioned within the aperture and has a distal end protruding vertically downward into the oil supply gallery to minimize the amount of air in the oil which is communicated to the hydraulically-actuated valve deactivation system. This prevents delay of valve deactivation after engine start-up as oil fills the oil supply gallery and displaces air from the oil supply gallery.

11 Claims, 1 Drawing Sheet

PICK-UP TUBE FOR HYDRAULICALLY-ACTUATED VALVE DEACTIVATION

TECHNICAL FIELD

The present invention relates to a pick-up tube which extends into an oil supply gallery in an engine block to speed the supply of oil to a hydraulically-actuated valve deactivation system to prevent delay of valve deactivation after engine start-up.

BACKGROUND OF THE INVENTION

Valve deactivation is used for improving fuel efficiency in engines. Valve deactivation cuts off one-half of the available cylinders by deactivating valve lift in those cylinders so that such cylinders remain closed after a combustion cycle of the engine and the burnt gases remain trapped within the cylinder during deactivation.

Some valve deactivators are used in internal combustion engines having a push rod-type valve gear train in which there is a rocker arm, with one end of the rocker arm engaging a push rod and the other end engaging the engine poppet valve. Typically, a central portion of the rocker arm is fixed relative to the cylinder head by a fulcrum arrangement in which the fulcrum normally prevents movement of the central portion of the rocker arm in an "up and down" direction. At the same time, the fulcrum permits the rocker arm to engage in cyclical, pivotal movement, in response to the cyclical motion of the push rod, which results from the engagement of the push rod with the lobes of the rotating camshaft.

There are a number of known valve deactivator assemblies which are operably associated with the fulcrum portion of the rocker arm and which, in the latched condition, restrain the fulcrum portion of the rocker arm to move in its normal cyclical, pivotal movement. However, in an unlatched condition, the valve deactivator assembly permits the fulcrum portion of the rocker arm to engage in "lost motion" such that the cyclical, pivotal movement of the push rod causes the rocker arm to undergo cyclical, pivotal movement about the end which is in engagement with the engine poppet valve. In other words, the rocker arm merely pivots, but the engine poppet valve does not move and therefore is in its deactivated condition.

U.S. Pat. No. 6,196,175 discloses a valve deactivator which is incorporated into a cam follower assembly and is hydraulically-actuated. This device includes an outer body member which engages and follows the cam and an inner body member disposed within the outer body member and reciprocable relative thereto. The inner body member includes means for transmitting the cyclical motion of the cam to the remainder of the valve gear means when the outer and inner body members are in a latched condition. A latch assembly is positioned within the inner body member when in the unlatched condition and includes a radially movable latch member. A source of pressurized fluid, such as oil, is operatively associated with the latch assembly and is operative to bias the latch member toward the unlatched condition.

A hydraulically-actuated valve deactivator, such as that described in the '175 patent, requires pressurized oil for operation. Such pressurized oil may be received from the engine block. When the engine is first started up, oil galleries of the engine block which might supply such oil would initially be filled with air. However, a solid column of oil would be required to initiate the hydraulically-actuated valve deactivator. Accordingly, cylinder deactivation is delayed until the hydraulically-actuated valve deactivator receives an air-free, pressurized supply of oil. Accordingly, it is desirable to decrease the time between engine start-up and supply of a solid column of oil to the valve deactivator.

SUMMARY OF THE INVENTION

The present invention overcomes the above-referenced shortcomings of prior art hydraulically-actuated valve deactivation systems by providing a pick-up tube which extends sufficiently into an oil supply gallery to prevent delay in the supply of a solid (i.e., air-free) column of oil to the hydraulically-actuated valve deactivation system.

More specifically, the present invention provides an engine assembly including an engine block with a laterally extending oil supply gallery formed therethrough. The engine block also includes an aperture formed in fluid communication with the oil supply gallery. A hydraulically-actuated valve deactivation system is positioned in fluid communication with the aperture for receiving pressurized oil from the oil supply gallery. A pick-up tube is positioned within the aperture and has a distal end protruding vertically downward into the oil supply gallery to minimize the amount of air in the oil which is communicated to the hydraulically-actuated valve deactivation system, thereby preventing delay of valve deactivation after engine start-up as oil fills the oil supply gallery and displaces any air from the oil supply gallery.

Another aspect of the invention provides a method of preventing delay in operation of a hydraulically-actuated valve deactivation system after start-up of an internal combustion engine. The method includes the step of providing a pick-up tube as described above which protrudes sufficiently into the oil supply gallery to enhance transfer of pressurized oil from the oil supply gallery into the hydraulically-actuated valve deactivation system after engine start-up to prevent delay of valve deactivation.

Accordingly, an object of the invention is to provide an improved valve deactivation system in which valve deactivation is available more quickly after engine start-up.

The above object and other objects, features and advantages of the present invention are readily apparent from the following detailed description of the best mode for carrying out the invention when taken in connection with the accompanying drawings.

DESCRIPTION OF THE PREFERRED EMBODIMENT

Figure 1:
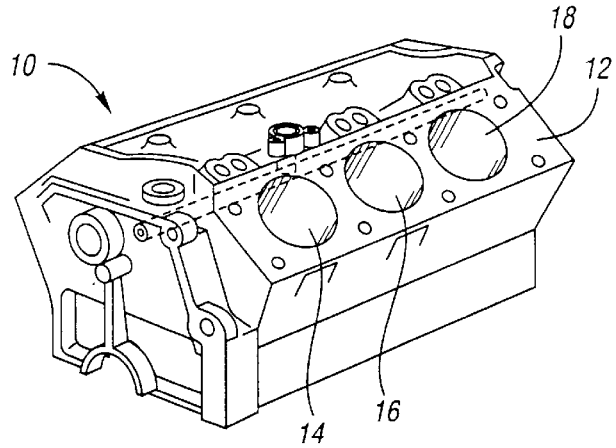
FIG. 1 shows a perspective view of an engine block in accordance with the present invention.

The invention will be described with reference to FIGS. 1–3, which provide schematic perspective and cross-sectional views of an engine assembly incorporating the present invention. As shown, the engine assembly 10 includes an engine block 12 having a plurality of cylinders 14, 16, 18 therein. The engine block also includes at least one oil supply gallery which receives pressurized oil from an oil supply source 22, and the oil is used, for example, to control a hydraulic latch adjuster, to feed camshaft bearings, etc.

With the present invention, a hydraulically-actuated valve deactivation system 24 is positioned in fluid communication with an aperture 26, which communicates with the oil supply gallery 20 for receiving pressurized oil from the oil supply gallery 20.

The hydraulically-actuated valve deactivation system 24 is operative to deactivate valves to improve engine fuel efficiency. By way of example, the hydraulically-actuated valve deactivation system 24 may comprise the deactivator assembly described in U.S. Pat. No. 6,196,175 and hereby incorporated by reference in its entirety. However, this invention would be useful for any hydraulically-actuated valve deactivation system. Another example would be a so-called "lifter oil manifold assembly" (LOMA) which receives the pressurized oil from the oil supply gallery, filters air from the oil, and communicates the oil with a deactivation device to create lost motion between a cam and a valve. By way of example, a portion 28 of a LOMA is shown in FIG. 3 and includes a channel 30 to receive oil from the aperture 26.

The present invention is particularly characterized by the pick-up tube 32 which is positioned within the aperture 26 and has a distal end 34 protruding vertically downward into the oil supply gallery 20 to minimize the amount of air in the oil which is communicated to the hydraulically-actuated valve deactivation system 24. In other words, the pick-up tube 32 enhances pick-up of a solid column of oil from the oil supply gallery 20.

Accordingly, this prevents delay of valve deactivation after engine start-up as oil enters the oil supply gallery 20 and displaces air from the oil supply gallery 20 because the pick-up tube 32 receives a solid column of oil before the oil supply gallery 20 is completely full.

Preferably, the pick-up tube extends at least approximately halfway across the oil supply gallery 20 to enhance oil pick-up. As described above, when the engine is started, the oil supply gallery 20 will begin to fill with oil 36 and displace the air 38 from the oil supply gallery 20. Without the pick-up tube 32 extending sufficiently downward into the oil supply gallery 20, there would be a significant delay before a solid column of oil would be transported into the hydraulically-actuated valve deactivation system 24. However, with the distal end 34 of the pick-up tube 32 dipping sufficiently downward into the oil supply gallery 20, a solid column of oil is provided into the hydraulically-actuated valve deactivation system 24 at an earlier stage in the filling of the oil supply gallery 20. Therefore, valve deactivation can occur almost immediately after engine start-up.

Figure 2:
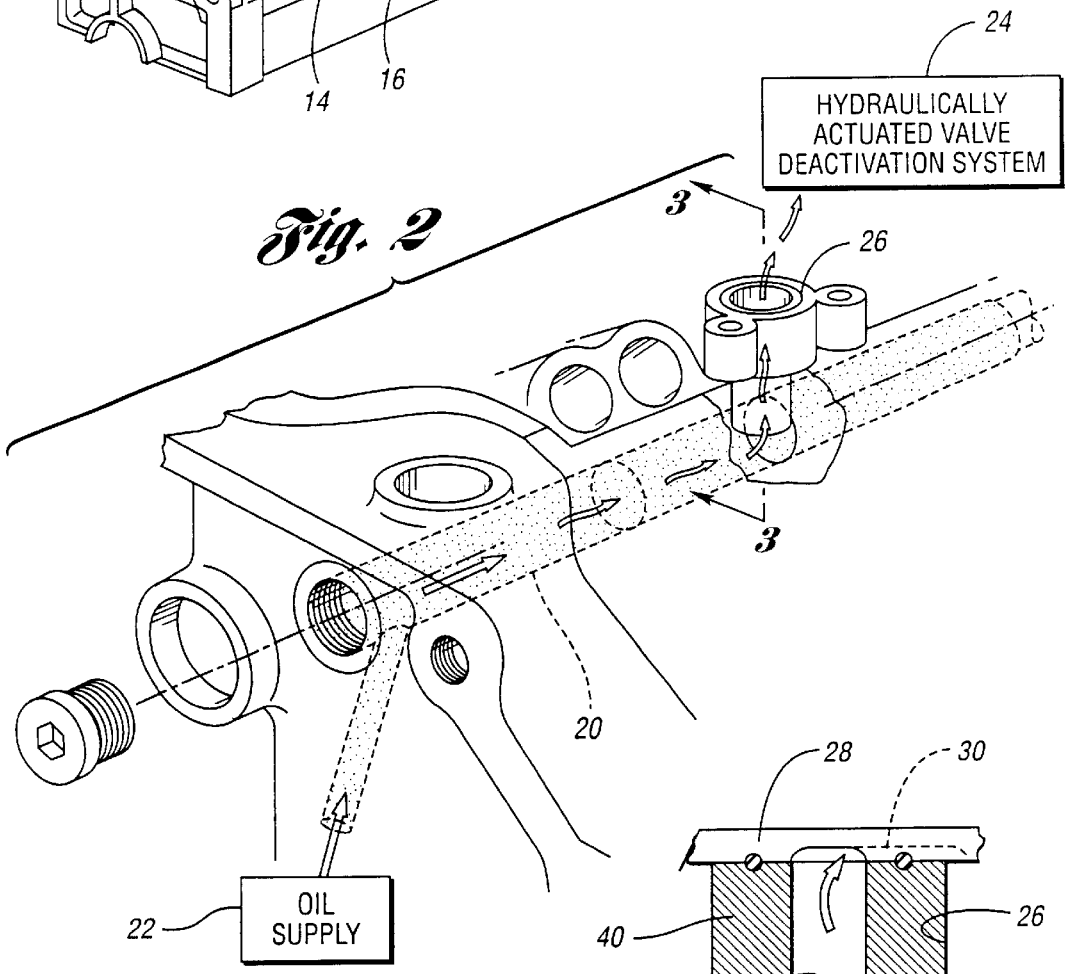
FIG. 2 shows a schematic enlarged cut-away, partially exploded perspective view taken from the engine block of FIG. 1.
Figure 3:
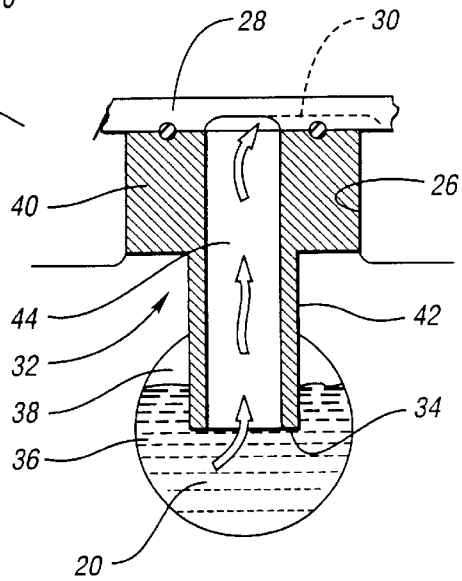
FIG. 3 shows a schematic cross-sectional view taken at line 3—3 of FIG. 2.

As shown in FIG. 2, the pick-up tube 32 includes a base 40 with a tube portion 42 extending therefrom and a channel 44 formed through the base 40 and tube 42 for transporting oil. The base 40 is press-fit into the aperture 26. The pick-up tube 32 may be aluminum, steel or plastic. The material selection would depend upon the material selection of the engine block, particularly to accommodate heat expansion compatibility and to provide a secure fit.

The tube 42 could be any desired length, width or thickness, and the depth to which the distal end 34 of the tube extends into the oil supply gallery 20 would be selected to enhance oil pick-up while preventing blockage of flow through the oil supply gallery 20.

In summary, for fuel economy and exhaust emissions considerations, it is very important to deactivate engine cylinders as soon as possible after start-up. Engine cylinder deactivation devices are most often actuated by hydraulic circuits. Hydraulic control circuits may be very sluggish and unpredictable when there is a significant amount of air/vapor in the control lines. Engine cylinder deactivation requires tight control of the hydraulic pressure timing. The deactivation signal cannot be activated until air is purged from the control channels.

In order to provide the deactivation of cylinders soon after starting of the engine, the pick-up tube 32 is provided and is operative to supply a solid stream of hydraulic oil more quickly after engine start-up to the hydraulically-actuated valve deactivation system. Preferably, the pick-up tube 32 extends sufficiently deep into the oil supply gallery or channel where less air/vapor would be present. Since air is more buoyant than oil, the air will tend to migrate to the top of the channel and thus avoid traveling up through the pick-up tube 32, as illustrated in FIG. 3.

While the best mode for carrying out the invention has been described in detail, those familiar with the art to which this invention relates will recognize various alternative designs and embodiments for practicing the invention within the scope of the appended claims.

What is claimed is:

1. An engine assembly comprising:

an engine block including a laterally extending oil supply gallery formed therethrough, said engine block including an aperture formed in fluid communication with said oil supply gallery, said oil supply gallery being partially filled with oil after engine start-up and having air displaced above the oil in the oil supply gallery;

a hydraulically-actuated valve deactivation system positioned in fluid communication with said aperture for receiving pressurized oil from said oil supply gallery; and a pick-up tube positioned within said aperture and having a distal end protruding vertically downward into, and partially across, the oil supply gallery beyond said displaced air and sufficiently into said oil to enhance transfer of oil from the oil supply gallery into the hydraulically-actuated valve deactivation system, thereby preventing delay of valve deactivation after engine start-up as oil fills the oil supply gallery and displaces any air from the oil supply gallery, while preventing blockage of oil flow through the oil supply gallery past the pick-up tube.

2. The engine assembly of claim 1, wherein said pick-up tube comprises a steel material.

3. The engine assembly of claim 1, wherein said pick-up tube comprises a plastic material.

4. The engine assembly of claim 1, wherein said pick-up tube comprises an aluminum material.

5. The engine assembly of claim 1, wherein said distal end of the pick-up tube extends at least approximately halfway across the oil supply gallery.

6. The engine assembly of claim 1, wherein the pick-up tube is pressed into the aperture.

7. A method of preventing delay in operation of a hydraulically-actuated valve deactivation system after start-up of an internal combustion engine, the method comprising:

providing a laterally extending oil supply gallery formed in an engine block of the engine, said oil supply gallery being partially filled with oil after engine start-up and having air displaced above the oil in the oil supply gallery;

providing an aperture in the engine block communicating the oil supply gallery with the hydraulically-actuated valve deactivation system; and providing a pick-up tube in the aperture and having a distal end protruding sufficiently downward into, and partially across, the oil supply gallery beyond said displaced air and sufficiently into said oil to enhance transfer of pressurized oil from the oil supply gallery to the hydraulically-actuated valve deactivation system, thereby preventing delay of valve deactivation after engine start-up as oil fills the oil supply gallery and displaces air from the oil supply gallery, while preventing blockage of oil flow through the oil supply gallery past the pick-up tube.

8. The method of claim 7, wherein said step of providing a pick-up tube comprises providing a steel pick-up tube.

9. The method of claim 7, wherein said step of providing a pick-up tube comprises providing a plastic pick-up tube.

10. The method of claim 7, wherein said step of providing a pick-up tube comprises providing an aluminum pick-up tube.

11. The method of claim 7, wherein said distal end of the pick-up tube extends at least approximately halfway across the oil supply gallery.

* * * * *